United States Patent [19]

Hasenwinkle et al.

[11] 4,117,755

[45] Oct. 3, 1978

[54] LOG TRANSPORT AND SAWING SYSTEM

[75] Inventors: Earl Dean Hasenwinkle; Frank Wislocker, both of Longview, Wash.

[73] Assignee: Weyerhaeuser Company, Tacoma, Wash.

[21] Appl. No.: 759,168

[22] Filed: Jan. 13, 1977

[51] Int. Cl.[2] ..... B27B 15/08; B27B 24/08

[52] U.S. Cl. ..... 83/435.1; 144/312; 83/425.3; 83/425.2; 83/730

[58] Field of Search ..... 83/435.1, 425, 425.2, 83/425.3, 708, 730, 437; 144/312

[56] References Cited

U.S. PATENT DOCUMENTS

| | | | |
|---|---|---|---|
| 10,023 | 9/1853 | Alexander | 83/425.3 |
| 436,420 | 9/1890 | Hodgson | 83/425.3 |
| 1,381,183 | 6/1921 | Gray | 83/708 |
| 2,051,256 | 8/1936 | Hilke | 83/425.2 |
| 2,803,272 | 8/1957 | Crosby | 83/730 |
| 2,870,803 | 1/1959 | Eppler | 83/435.1 |
| 3,875,841 | 4/1975 | Noble et al. | 83/708 |

FOREIGN PATENT DOCUMENTS

| | | | |
|---|---|---|---|
| 210,699 | 10/1957 | Australia | 83/435.1 |

*Primary Examiner*—Donald R. Schran

[57] ABSTRACT

A log sawing and transport system for relatively small logs has an infeed and loading station where logs are positioned in a centering device for aligning the logs with respect to the saws. Once the log is properly aligned for axial movement, a set of end dogs are actuated to hold the log in its prealigned position for transport. The dogs are mounted within axially movable carriage units that travel the length of the system serving to transport the log axially in a straight line. At the sawing station a plurality of angularly arranged saws are disposed to divide the traveling log into a plurality of elongated sector-shaped pieces. At least one selected saw may be adjustable with respect to the other saws in order to set angles for the sector-shaped pieces. Once the log has been divided into a plurality of sector-shaped pieces, an outfeed device collects the elongated sector-shaped pieces and transports them out of the system.

5 Claims, 15 Drawing Figures

LOG TRANSPORT AND SAWING SYSTEM

BACKGROUND OF THE INVENTION

This invention relates generally to a log transport and sawing system for breaking a substantially cylindrical log into a plurality of individual elongated pieces. More particularly, it relates to an end dogging and axial transport system for moving logs past a plurality of angularly disposed saws for dividing the log into a plurality of elongated sector-shaped pieces.

The art of quarter sawing is well known and is utilized in the hardwood lumber and veneer manufacturing industry. To quarter saw a log, a log is mounted in a suitable holding device and is then sawn into sector-shaped pieces with a normal angle between radial faces being on the order of 90°. One typical means for quartering a log is simply to mount the log in a well-known carriage and pass it by a vertically disposed band saw where it is halved. Each individual half is then mounted on a similar carriage and passed by a similar band saw where it is quartered. The quarter sectors are then sawn into lumber or sliced into veneers. This process is time consuming and also has a tendency to produce irregular quarter sectors since several passes past a saw are required in order to produce the quarter sectors.

In the log cutting and rejoining process that is described in U.S. Pat. No. 3,961,654 which is assigned to assignee of the present invention, a process is disclosed whereby relatively small logs are sawn or otherwise divided into a plurality of individual elongated sector-shaped pieces and then rejoined into parallelograms thin edge to thick edge. As is disclosed within the patent, one of the first steps in the manufacturing process is to substantially quarter a log. The disclosure indicates that any known quarter sawing process could be utilized for producing substantially quarter sectors from the logs. Based on production requirements, it has been determined that the known processes and systems for quartering a log are slow and tend to yield sector-shaped pieces, as previously noted, that are nonuniform and which would tend to be unsuitable for use in the process of U.S. Pat. No. 3,961,654. Thus a log transport and quarter sawing system that produces substantially quarter elongated sector-shaped pieces at suitable production speeds and with the required degree of uniformity in size is required for efficiently practicing the aforementioned process.

Accordingly, from the foregoing, one object of the present invention is to provide a transport system for sawing logs that both positions and accurately transports the log through a predetermined path of travel.

Another object of this invention is to securely hold the log in its prealigned position as it is being transported through a sawing station.

Still a further object of this invention is to provide a sawing station that produces a plurality of individual elongated sector-shaped pieces substantially simultaneously from the same log.

Yet another object of this invention is to provide a sawing station comprised of a plurality of saws whereby the angular relationships between at least some of the saws may be varied depending upon the sizes of the sector-shaped pieces to be cut.

Still a further object of the present invention is to provide a transport system that has variable feed speeds for both sawing and carriage return.

These objects and many others will become fully apparent upon reading the specification to follow in conjunction with the attached drawings.

SUMMARY OF THE INVENTION

Briefly stated, this invention is practiced in one form by a log positioning, transport, and sawing system that includes a loading and positioning station where a log is positioned for axial transport by a vertically movable set of holding arms together with a set of horizontally moving holding arms. The two sets of holding arms are aligned according to the center line of a log in relation to the center point of the sawing station. Once the log is prepositioned, a set of end dogs move into position to grasp the log in its prealigned orientation. The last set of holding arms retract and the sets of axially movable carriages supporting the end dogging mechanisms are actuated to transport the log axially in the downstream direction. The carriages may be mounted on roundways and guided by guide wheels for accurate axial transport. The sawing station is comprised of a plurality of saws that are angularly disposed with respect to each other. After a log has passed through the sawing station, the resulting elongated sector-shaped pieces will be released from the transport system.

DESCRIPTION OF THE PREFERRED EMBODIMENT

Figure 1A:
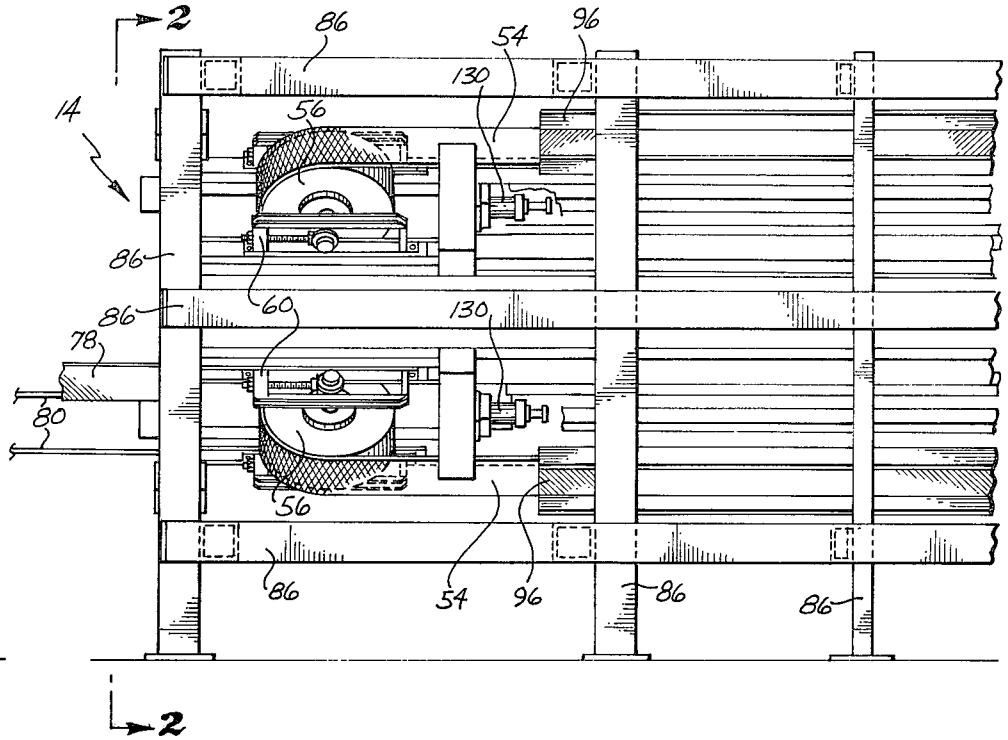
FIG. 1 is comprised of parts A and B which together form a full side elevation view showing the system of the present invention.
Figure 2:
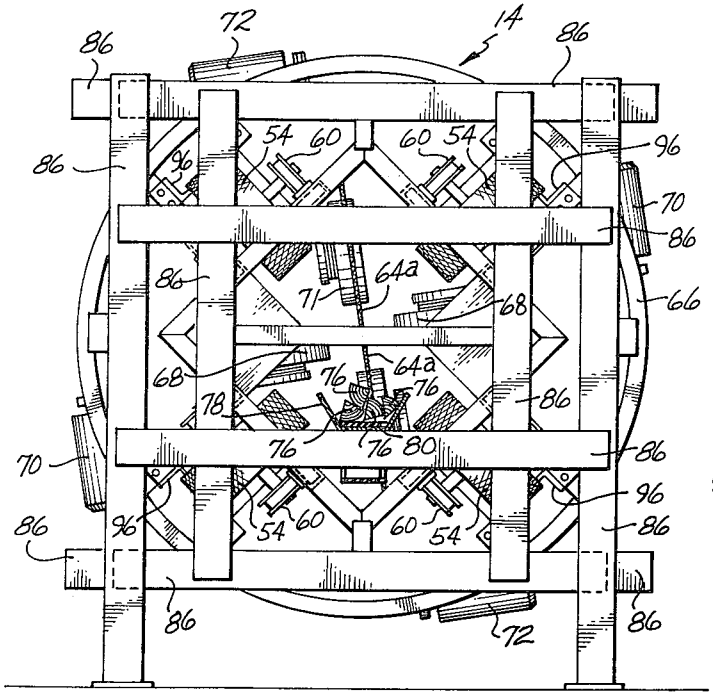
FIG. 2 is an end elevation taken along line 2—2 of FIG. 1 and shows the outfeed end of the system.
Figure 1B:
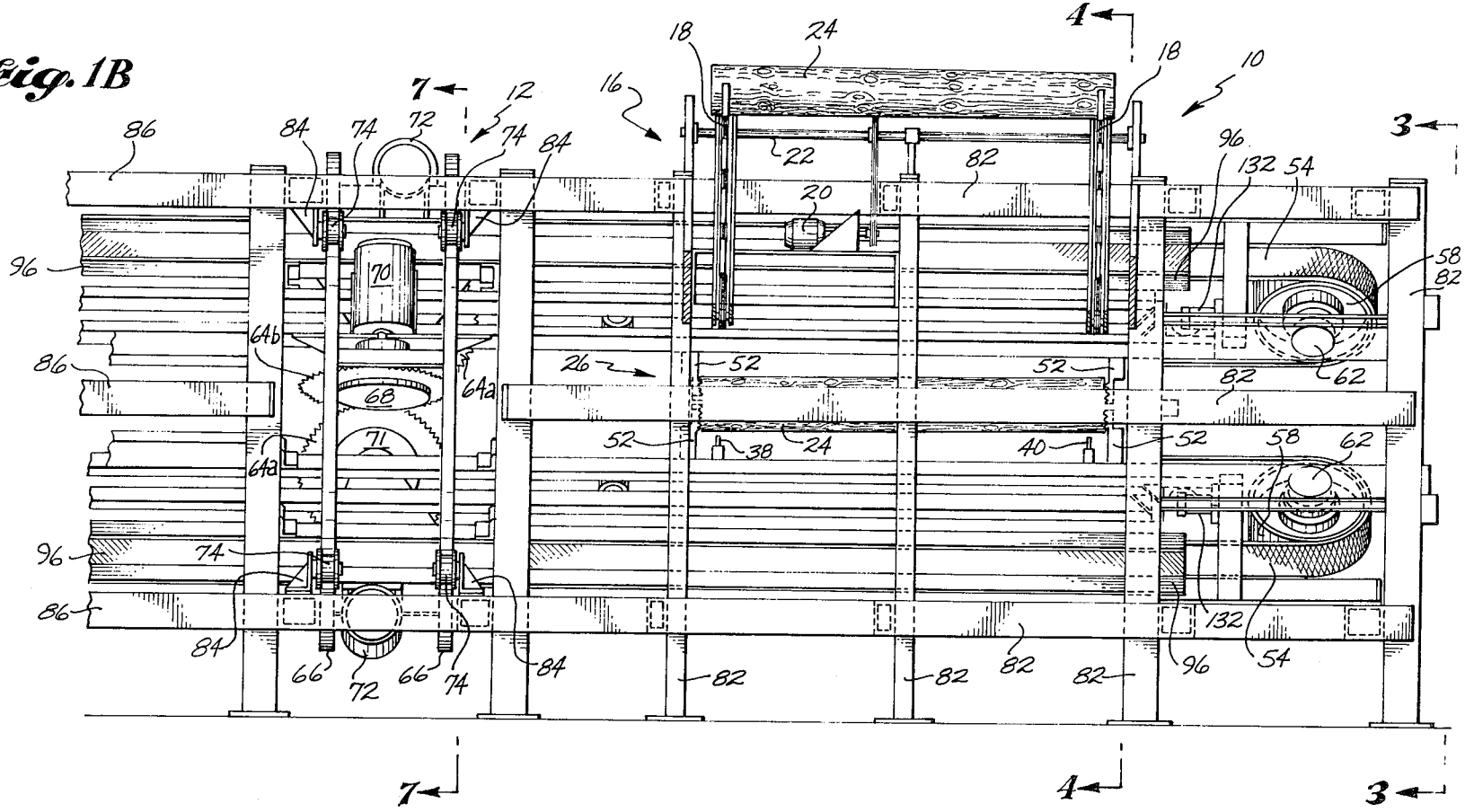
Figure 3:
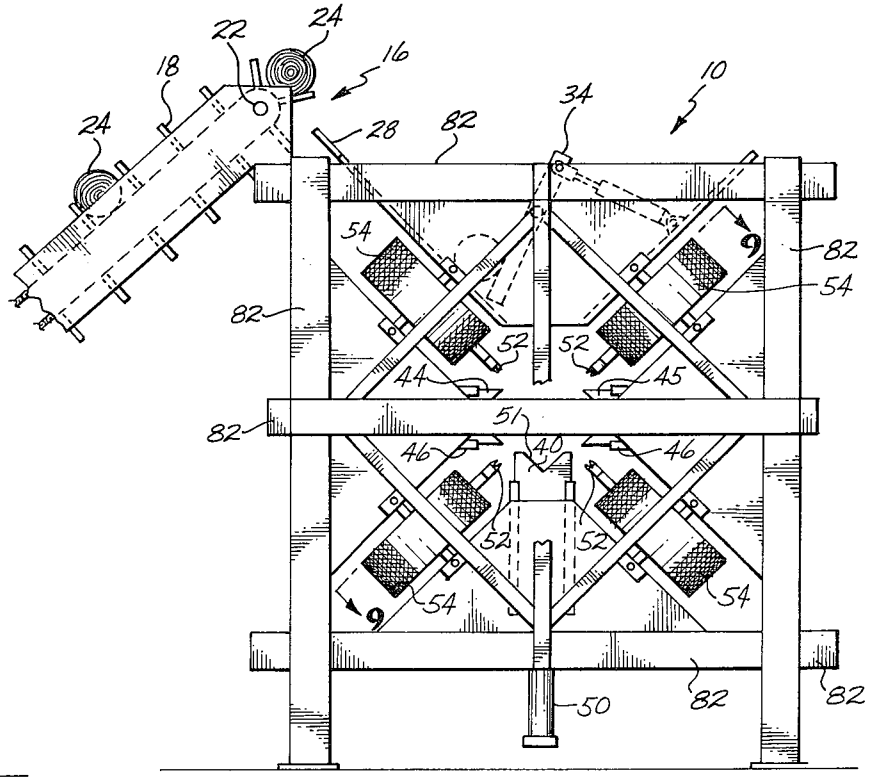
FIG. 3 is also an end elevation view taken along line 3—3 of FIG. 1 and shows the log loading and positioning station.

Referring first to FIGS. 1–3, a general description will be given of the log positioning, transport, and sawing system comprising the present invention. The system is designed for axial movement of a log from an infeed end generally indicated at 10, through a work station generally indicated at 12, to the outfeed end generally indicated at 14. At infeed end 10 there is a log loading station generally indicated at 16 comprised in part of an upwardly inclined transverse conveyer 18 that extends upwardly from a typical infeed deck (not shown) to the top of infeed end 10. A suitable drive motor 20 is connected to a drive shaft 22 which powers conveyer 18. As an individual log, each of which is indicated by reference numeral 24, reaches the top of transverse conveyer 18, it will then be carried downwardly toward the log positioning station 26. Forming a part of log loading station 16 is a downwardly extending inclined ramp 28 along which a log 24 can either be positively conveyed or allowed to roll gently downward to a position where it will be stopped by pivotal stopping mechanism 30. Pivotal stopping mechanism 30 is comprised of an axially extending supporting shaft 32 on which are pivotally mounted a plurality of stop arms 34. Serving to pivot the arm 34 back and forth in a transverse direction is a suitable double-acting actuating cylinder 36.

Positioned beneath stopping mechanism 30 is log positioning station 26 which is comprised of a pair of axially spaced vertically movable holding arms 38, 40 together with two axially spaced pairs of transversely spaced, horizontally adjustable holding arms 42, 43 and 44, 45 respectively. Each of the respective holding arms is supported for its adjusting movements in suitable guide means each indicated at 46 and serving to move each of the holding arms in a coordinated manner is a plurality of double-acting positioning cylinders. Those providing horizontal movement to holding arms 42, 43 and 44, 45 are indicated at 48 and those serving to provide the vertical positioning movement for holding arms 38, 40 are indicated at 50. Each of the holding arms has a holding notch 51 at its log holding and positioning end.

In the embodiment depicted, the positioning station 26 functions to align the longitudinal axis of an incoming log 24 in an orientation so that when it is transported axially the center line will travel along a predetermined straight path. With the stop arms 34 holding a log 24, the vertically adjustable holding arms 38, 40 will be moved upwardly to a position adjacent the bottom edge of inclined ramp 28. When holding arms 38, 40 are in position, the stop arms 34 are pivoted transversely allowing the log to fall into holding notches 51. After the positioning cylinders 50 move the log in the vertical direction to a predetermined position, the horizontally adjustable holding arms 42, 43 and 44, 45 are then moved inwardly toward each other and stop in a coordinated position whereby the center line of log 24 will then be positioned in its predetermined orientation as previously noted.

Once a log 24 has been prealigned and is being held in its spatial orientation by arms 42, 43 and 44, 45, the holding arms 38, 40 having been retracted, end dogging mechanisms will be actuated to firmly grasp the log for transport through work station 12. The end dogging mechanisms, each end dog of which is indicated at 52 in FIGS. 1 and 3, are carried on axially movable carriage mechanisms which will be described in greater detail later. At this point, however, with reference to FIGS. 1–3, it should be pointed out that the end dogging and carriage mechanisms are driven in part by a plurality of axially extending, angularly disposed inclined traveling belts each of which is indicated at 54. Each traveling belt 54 is suitably supported in its axial run by a pair of end pulley mechansims each of which is indicated at 56 and 58 respectively. Those pullies 56 holding each belt at outfeed end 14 are supported in adjustable support mechanisms 60 which allow tension adjustments to be made to each belt. The respective end pullies 58 at infeed end 10, in addition to providing support, also have a hydraulic motor 62 integrally mounted within the pulley serving to drive belts 54 in a controlled cooperative manner.

Work station 12 is depicted in the figures as being a sawing station having a plurality of round saws 64, two of which **64*a* are mounted on a rotatable ring frame 66 for angular adjustment while the other two saws 64*b* are disposed in a substantially horizontal plane and are the saws that are fixed in position on a stationary frame. The fixed saws 64*b* are held in their transversely opposed spatial orientations on collar-arbor arrangements, each of which is indicated at 68, which in turn are supported on a stationary frame. The fixed saws are driven by any suitable drive means although in the embodiment depicted they are belt-driven by a pair of suitably positioned drive motors, each indicated at 70. The other pair of saws 64*a* are similarly mounted on collar-arbor arrangements 71 which are in turn mounted on frame means within rotatable ring frame 66. Similarly, a pair of drive motors 72 is fixedly attached to ring frame 66 and serves to drive the adjustable saws through a belt drive arrangement. The rotatable ring frame 66 is mounted on a plurality of support rollers 74 which track about the circumference of each axially spaced ring. The saws 64*a* can be adjusted angularly about the axial center line by rotating ring frame 66** with the saws moving within the area between the top transversely spaced pair of belts and the bottom transversely spaced pair of belts.

Downstream from work station 12 a plurality of individual elongated sector-shaped pieces, each indicated at 76, will be released from the end dogs 52. Once the sectors 76 are released, means must be provided for collecting them and then transporting them further downstream past outfeed end 14. A suitable axially extending trough structure 78 is provided to collect the sectors as they are released from end dogs 52. Traveling within the bottom of trough 78 is an endless belt 80 which is powered and serves to carry the sector-shaped pieces 76 out of the system. Again, as may be seen by referring to FIG. 2, the outfeed conveyer will be positioned below the axial center line of the work station and substantially between the bottom pair of belts 54 until it reaches and extends axially past the pullies 56 at the outfeed end.

As may be seen in FIGS. 1–3, a substantial amount of structural support is provided in order to support the various elements in their proper spatial relationships. At infeed end 10 a plurality of vertically extending, axially extending, and transversely extending beam members each indicated at 82 serve to support loading station 16, positioning station 26, and the other related elements. At work station 12 a suitable supporting structure indicated at 84 is provided for mounting support rollers 74.

As previously noted, suitable supporting structure is also provided for the saws. At outfeed end 14 an additional number of vertically extending, axially extending, and transversely extending beams each indicated at 86 are provided in order to support the outfeed mechanism together with end pullies 56.

Figure 4:
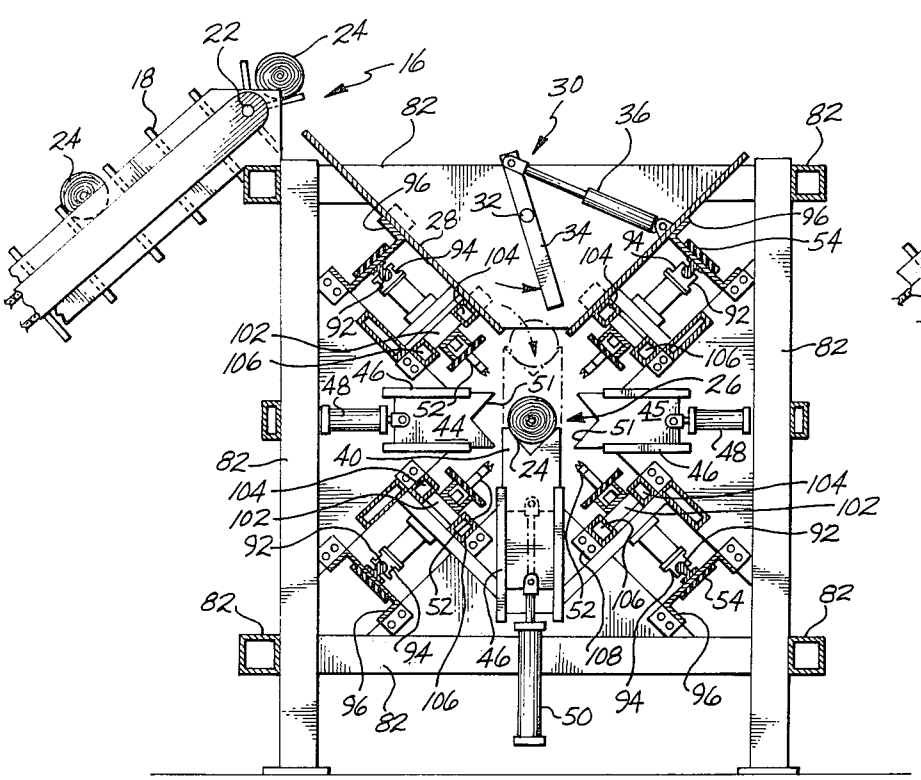
FIG. 4 is a sectional view taken along line 4—4 of FIG. 1 and shows in more detail the log loading and positioning station.
Figure 6:
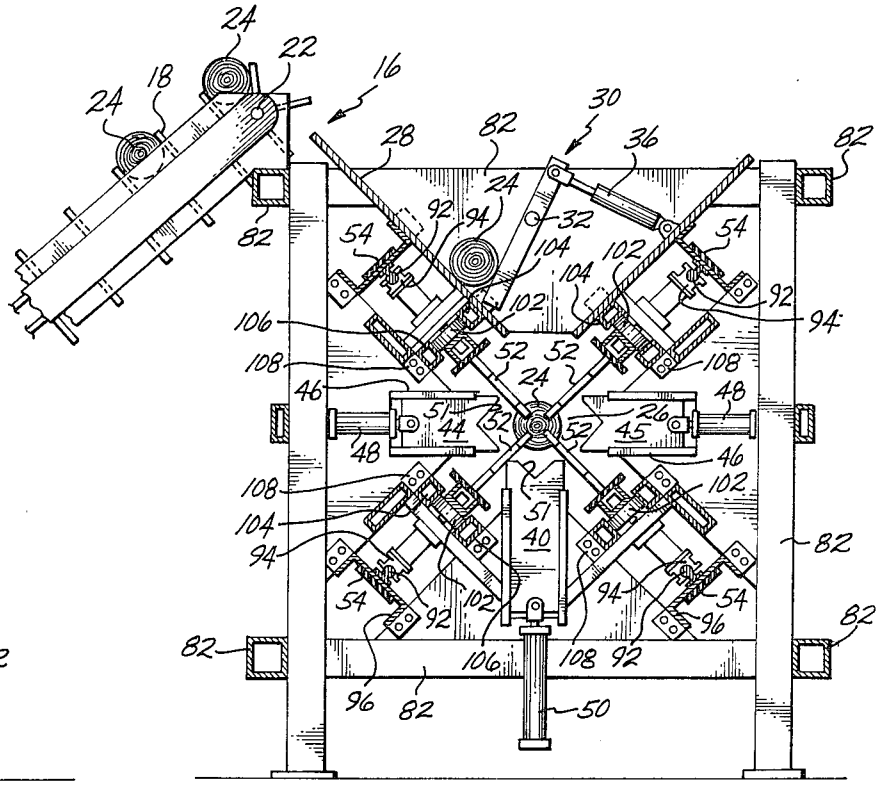
FIG. 6 is also a view similar to FIG. 4 and shows the log just after it has been dogged at both ends with the holding arms retracted.
Figure 5:
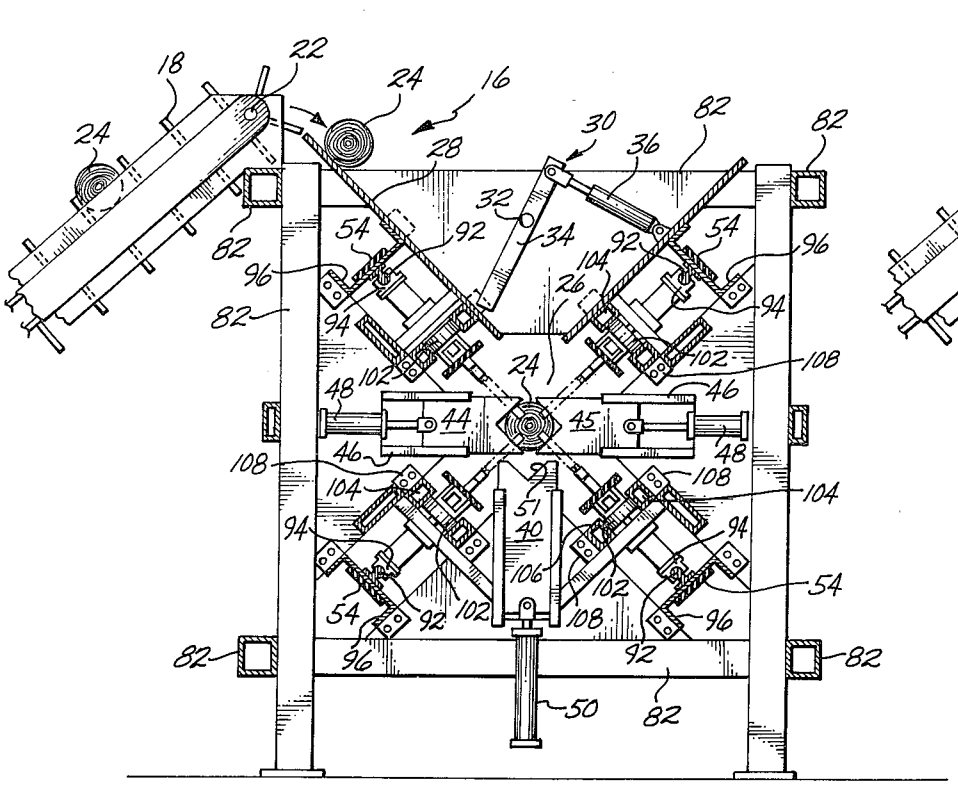
FIG. 5 is a view similar to FIG. 4 only showing the log loading and positioning station at a different step in the positioning sequence.

Referring now to FIGS. 4–6, additional details of the positioning station 26 will be described. As previously noted, the vertically adjustable holding arms 38, 40 have several vertical positions with their retracted position being when the holding arms are in their lowest position. A second fully extended position is indicated in FIG. 4 by the dashed outline and is the position where the holding arms 38, 40 accept a log 24 from loading station 16. The third intermediate position of holding arms 38, 40 is at a vertically lower position than the fully extended position and is controlled so as to approximately orient the center line of the log in the horizontal plane which is substantially coplanar with the horizontal plane through the center point of work station 12. The centering may be carried out in part by an electro-optical scanning and computer process control means (not shown).

When the holding arms 38, 40 are in either their second or third position, end dogs 52 will be retracted as will become more apparent later. When a log 24 is positioned vertically, the horizontally adjustable sets of holding arms 42, 43 and 44, 45 will move inwardly from a retracted position to a position where a side holding force is exerted on the log as may best be seen by referring to FIG. 5. At this point, the log 24 will be aligned in its position for axial travel. While the log is being held by the horizontally adjustable holding arms, the sets of end dogs 52 will be actuated to grasp each end of the log at four substantially coaxial points at each end. Once the end dogs 52 are in position and securely holding the log, the horizontally adjustable holding arms 42, 43 and 44, 45 are retracted to their first position. This configuration is best seen by referring to FIG. 6.

Figure 8:
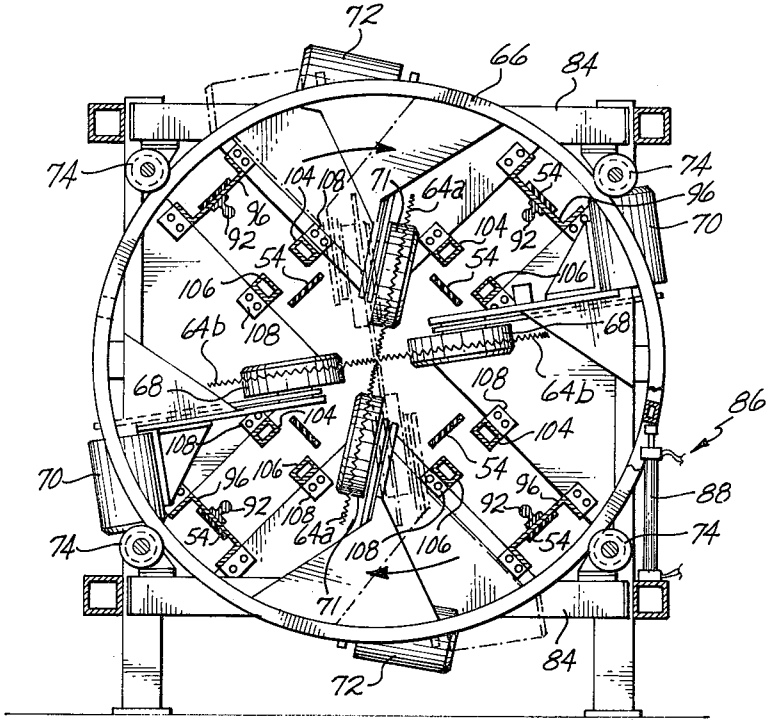
FIG. 8 is a view similar to FIG. 7 and shows the circular frame at a different position with a different angular relationship for the four saws.
Figure 7:
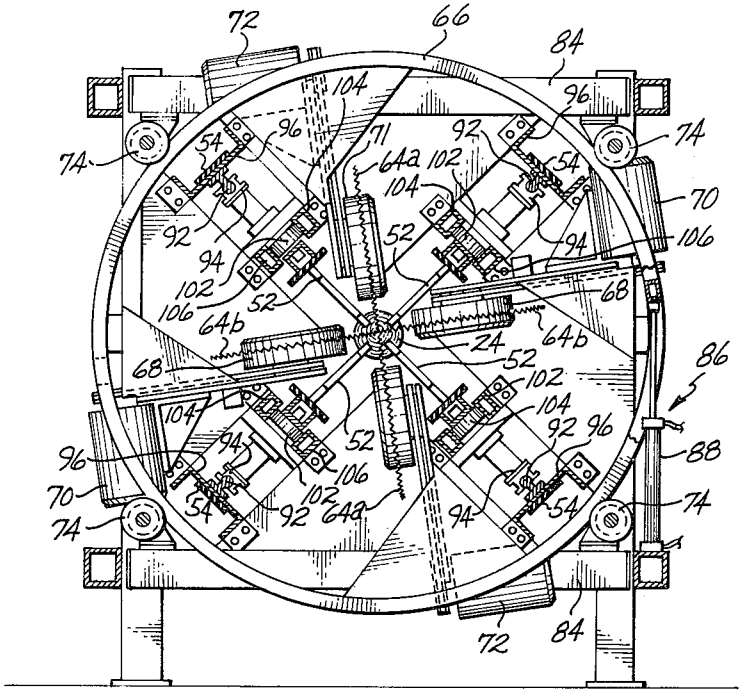
FIG. 7 is a cross-sectional view taken along line 7—7 of FIG. 1 and shows the circular rotatable frame for setting at least two of the saws in the set of four angularly disposed round saws.

Before turning to a more detailed description of the end dogging and carriage mechanisms, additional details of work station 12 will be given which may be clearly seen by referring to FIGS. 7 and 8. In FIG. 7 the saw arrangement is such that substantially quarter sectors will be cut from a given log. That is, each saw is approximately 90° from the next adjacent saw. For certain applications, it will be recognized by those skilled in the art that the saws will remain in such angular orientation since all that will be required from production runs are in fact quarter sectors. If this is the design choice, then each saw could be fixedly mounted on a frame structure and the rotatable ring could be eliminated. However, in the embodiment disclosed, as previously noted, the two substantially vertically disposed saws are in fact mounted on rotatable ring 66 for angular adjustment with respect to the other saw pair. In FIG. 7 the adjusting mechanism, generally indicated at 86, inclues a vertically extendable multi-position actuating cylinder 88. The cylinder 88 is controlled to rotate ring 66 about its center line and when it is actuated it swings the adjustable saws **64*a* to a different angular position with respect to the other pair of fixed saws 64*b*. This configuration may be seen by referring to FIG. 8. Any other suitable positioning means for rotating and holding ring frame 66 could be provided to carry out the positioning function. With respect to positioning of the tips of saws 64 for making the cuts, three of the saw tips are transversely spaced from the center line a distance which is approximately equal to the kerf of a saw blade and then the last saw will be positioned slightly downstream of the other three to complete the cut and free the individual elongated sector-shaped pieces (see FIGS. 9 and 10**).

Figure 9:
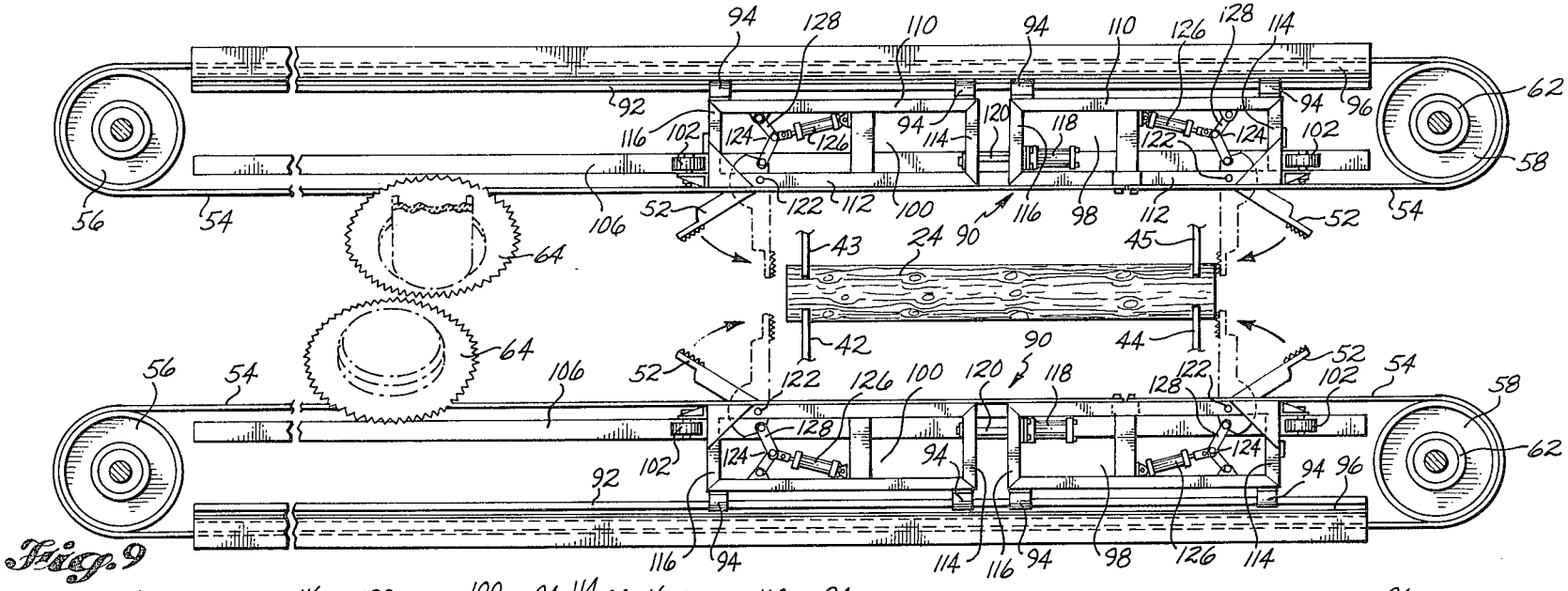
FIG. 9 is a cross-sectional view taken along line 9—9 of FIG. 3 and shows the carriage and end dogging sets ready to grasp a log.
Figure 10:
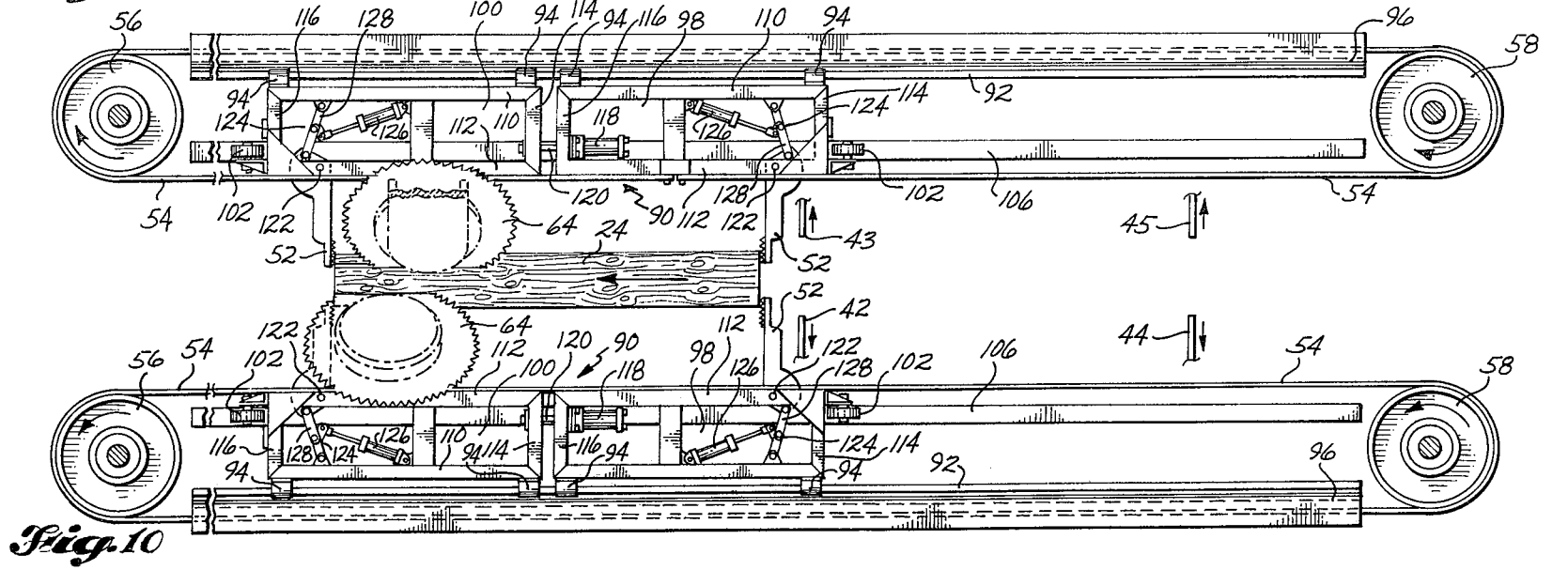
FIG. 10 is a view similar to FIG. 9 and shows two of the dogging sets and their carriages transporting a log through the sawing station.

Turning now to FIGS. 9 and 10, the details will be given of the end dogging and carriage mechanisms that form a substantial part of the transport system within the overall machine system. FIG. 9 is, as previously noted, a cross-sectional view taken along line 9—9 of FIG. 3 to show the spatial relationships and distances between operating elements. The end dogging and carriage mechanisms are generally indicated at 90 in each of the figures and in FIG. 9 the two end dogging and carriage mechanisms are shown in their axially retracted positions ready for grasping a log 24 at log positioning station 26. Each end dogging and carriage mechanism 90 is mounted for axial travel on slightly diverging roundways 92 that extend in the axial direction between the respective end pulley mechanisms 56, 58. A single roundway 92 supports each carriage on a plurality of linear bearings 94 which are attached to the tops of the carriages. The roundways 92 are, of course, rigidly supported in fixed positions to provide accurate transport. As a part of the function of support means 96 for the roundways, the back run of each traveling belt 54 may be guided over the roundway support means. As previously noted, roundways 92 diverge slightly as they extend from infeed end 10 to outfeed end 14 and the divergance is to allow end dogs 52 to pull the sector-shaped pieces outward slightly as they are cut at work station 12. This divergance prevents binding of the saws.

Each carriage mechanism is comprised of two parts with the parts being axially movable with respect to each other for clamping the end dogs 52 onto a log 24. The upstream portion 98 and the downstream portion 100 are guided in their axial travel by rotatable guide wheels 102 which are supported on the portions 98, 100 and are guided by pairs of axially extending spaced tracks 104, 106. The tracks 104, 106 associated with each carriage mechanism extend for substantially the same distance as roundways 92; that is, from the infeed end 10 to the outfeed end 14. The axially extending pairs of tracks 104, 106 are suitably supported in a manner similar to roundways 92 on support means 108. Each carriage portion 98, 100 is substantially rectangular and has a top and bottom axially extending side frame member 110, 112 and front and back transversely extending end frame members 114, 116 respectively. The bottom axially extending side frame member 112 within each carriage portion is that side frame member which is nearest the axial center line through the work station. The front frame member 114 within each carriage portion is that end frame member that is on the upstream end of each respective portion 98, 100. Connecting each of the pairs of carriage portions together for relative axial movement therebetween is a clamping actuating cylinder 118 with the ram end 120 of each cylinder being fixedly connected to carriage portion 100 and the cylinder body being fixedly connected to the axially opposed carriage portion 98. By activating each cylinder 118, the respective carriage portions can be moved toward or away from one another.

Serving to power the carriages and end dogs 52 in the axial direction as previously noted are the traveling belts 54. A portion of each belt will overlie each bottom axially extending side frame member 112. However, the belts 54 will only be fixedly attached to one of the carriage portions 98 or 100, thereby allowing the other carriage portion to move relative to the other as previously noted. In the embodiment depicted in FIG. 9 the belts 54 are attached through any suitable means to the upstream carriage portions 98. When hydraulic motors 62 are activated, each traveling belt 54 will motivate the carriages accordingly along roundways 92 and between tracks 104, 106.

The end dogging sets within each carriage mechanism are comprised of a pair of axially spaced, pivotally mounted end dogs 52. Each end dog is mounted on a bottom axially extending frame member 112 with one being mounted toward the downstream end of downstream carriage portion 100 and the other of a set being mounted toward the upstream end of the upstream carriage portion 98. Each end dog of a respective pair within an end dogging and carriage mechanism 90 is movable between a retracted lower position and an extended transversely extending dogging and holding position. In FIG. 9 the dashed lines represent the extended positions while the solidly shown end dogs 52 are being raised from the retracted lower positions. Each end dog 52 is mounted at a pinned connection point 122 and has a pivotal actuating means 124 positioned within each carriage portion. Each pivotal actuating means 124 inclues a positioning cylinder 126 that is operatively connected to the end dog 52 through linkage mechanisms 128. As may be seen in FIG. 9, when the respective cylinders 126 are retracted, so too are the end dogs 52. When cylinders 126 are fully extended, so too are end dogs 52. As previously noted, when a log 24 is being held by the horizontally adjustable holding arms 42, 43 and 44, 45 and prior to actuation, the end dogs 52 will be in their retracted positions. When the vertically adjustable holding arms 38, 40 retract to their lowest position, a control signal will activate cylinders 126 and end dogs 52 will pivot outwardly and into an extended position ready for clamping of log 24. Once end dogs 52 are locked in their extended positions, the clamping cylinders 118 will be activated to move the upstream and downstream carriage portions 98, 100 toward each other thereby moving the end dogs into a clamped relationship with the log 24. When clamping cylinders 118 are locked in position and after log 24 is being firmly held, the horizontally adjustable holding arms 42, 43 and 44, 45 will retract and, when they are fully retracted, a control signal will activate hydraulic motors 62 thereby beginning the transport of log 24.

Once the log 24 and end dogging and carriage mechanisms 90 clear work station 12 and when a downstream edge of the downstream carriage portions 98 impact shock absorbing and stopping cylinders 130 (see FIG. 1A) suitably supported at outfeed end 14, the hydraulic motors 62 will stop. The carriages will also come to a stop and a signal will then cause positioning cylinders 126 to retract end dogs 52, thereby releasing or dropping each elongated sector-shaped piece 76 into the trough structure 78 atop endless belt 80. Substantially simultaneously therewith clamping cylinder 118 will be activated to increase the spacing between each pair of upstream and downstream carriage portions 98, 100. Also substantially simultaneously, the hydraulic motors 62 can be reversed in order to move the end dogging and carriage mechanisms back to their retracted positions at infeed end 10. Once the carriages have returned to the infeed end 10 surrounding log positioning station 26, another log 24 can be loaded, positioned, and dogged for transport through work station 12.

Positioned at infeed end 10 similarly to those at outfeed end 14 are a plurality of shock absorbing and stopping cylinders 132. These cylinders, of course, serve to stop the carriage travel when it returns to the infeed end 10. Suitable sensing means (not shown) can be associated with cylinders 132 to sense the presence of the end dogging and carriage mechanisms 90 and in response thereto can signal the loading station 16 and log positioning station 26 to cyclically carry out their functions.

Figure 11:
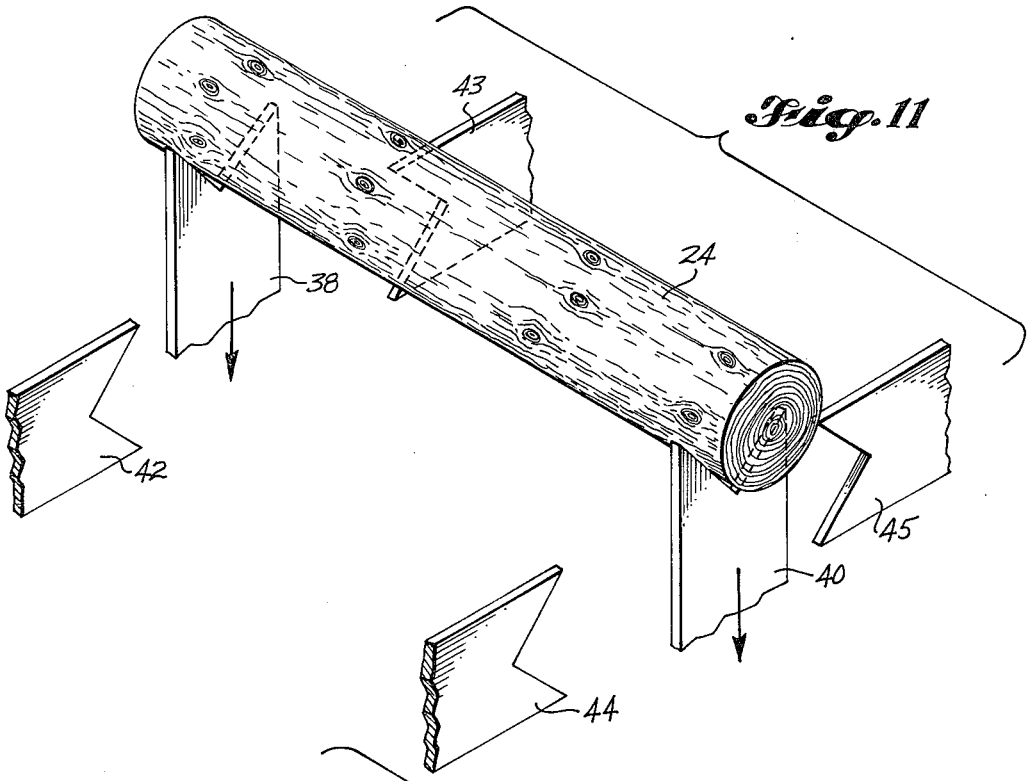
FIG. 11 is an isolated isometric view showing the positioning station.
Figure 12:
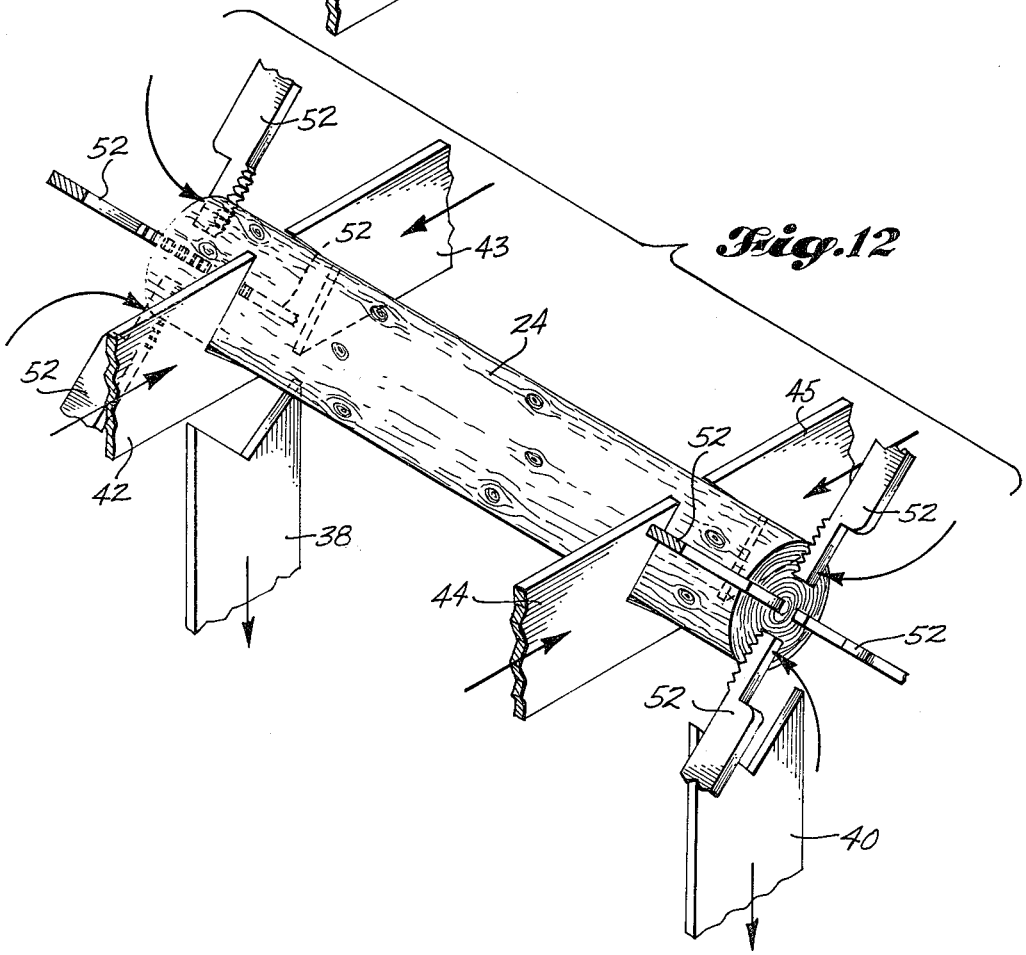
FIG. 12 is a view similar to FIG. 11 and shows the dogging sets as they grasp and hold a log in its predetermined spatial orientation.
Figure 13:
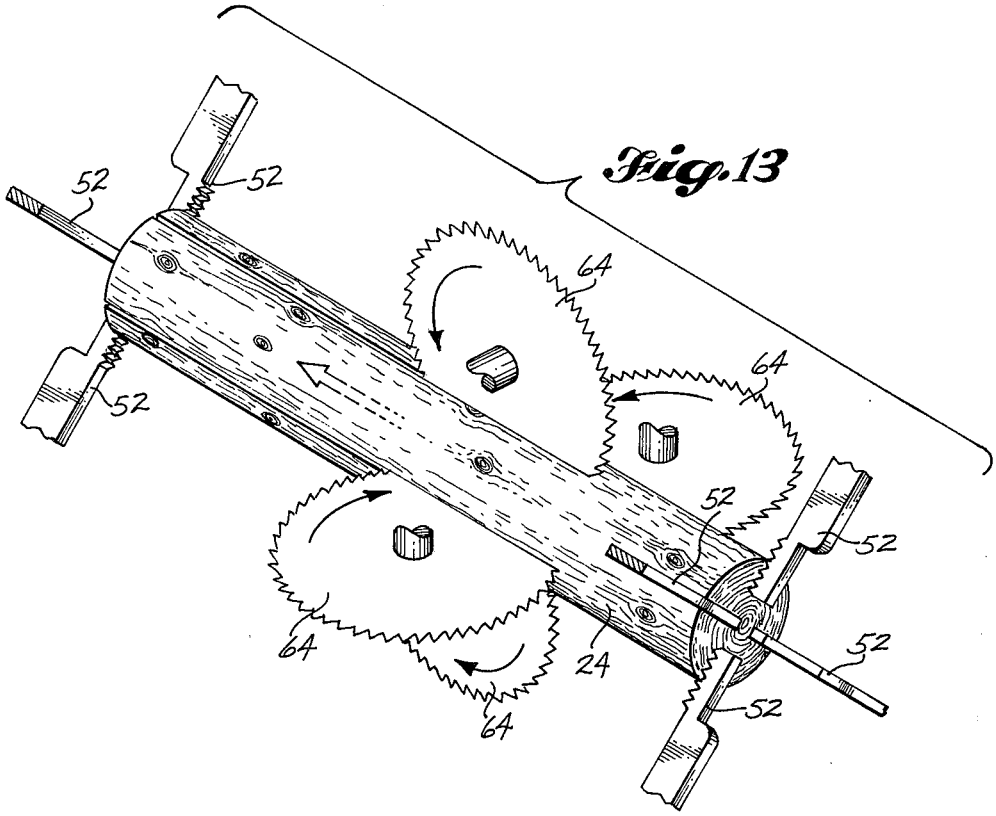
FIG. 13 is an isolated isometric view of a dogged log being transported through the sawing station.
Figure 14:
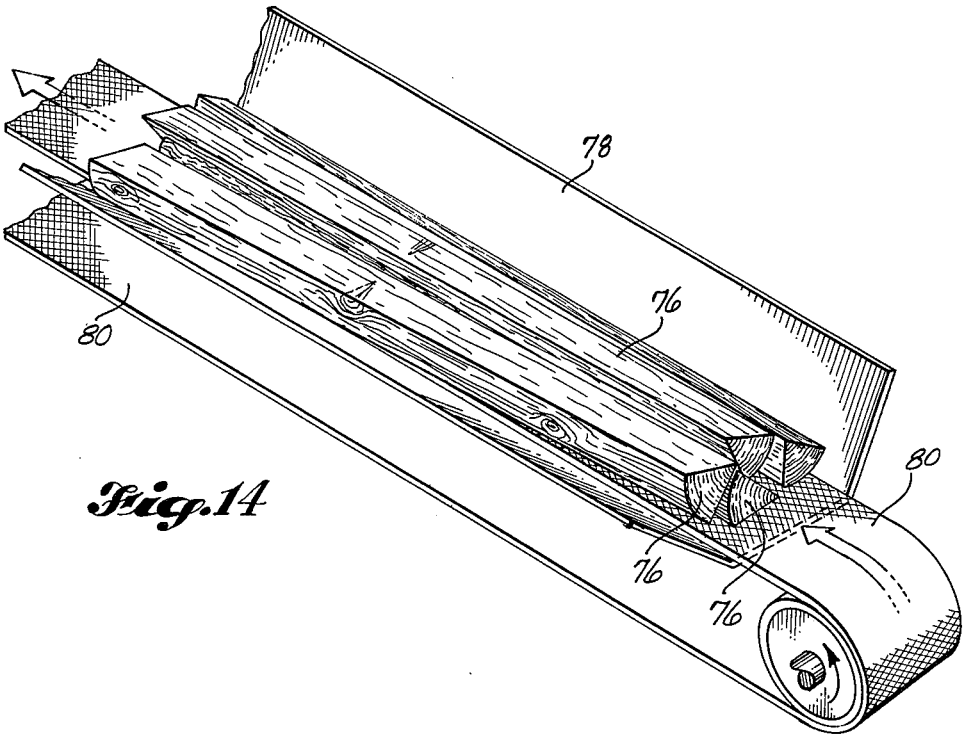
FIG. 14 is an isolated isometric view of the outfeed conveyor for carrying the plurality of elongated sector-shaped pieces away from the system.

FIGS. 11–14 are substantially schematic representations of the various major functions within the overall system. FIG. 11 depicts the positioning station 26 with a log 24 about to be grasped by the horizontally adjustable holding arms 42, 43 and 44, 45. FIG. 12 shows the pairs of end dogs 52 moving into position for clamping. FIG. 13 shows a log being transported through work station 12. FIG. 14 shows the resulting elongated sector-shaped pieces 76 being conveyed axially downstream atop endless belt 80.

While a detailed description of a preferred embodiment of the invention has been described together with a description of its operation, it will be recognized that many changes and modifications may be made without departing from the true spirit of the invention. All such modifications are intended to be included within the scope of the appended claims.

What is claimed is:

1. An apparatus having an infeed end and an outfeed end for axially transporting logs through a work station, comprising:

means for positioning a log upstream from said work station and placing it in an aligned orientation where its center line is substantially in line with the axial path it will travel when being transported through said work station, means for dogging and holding said log in its aligned orientation at a plurality of locations circumferentially spaced on each cross-sectional end of said log with said locations being substantially opposed and coaxial at opposite ends of said log and spaced outwardly from said center line, said dogging means including a plurality of dogging members extending inwardly toward the center line but terminating outwardly therefrom, carriage means angularly spaced from one another for supporting said dogging and holding means as a log is transported axially through said work station from said infeed end to said outfeed end, means at said work station for working on a traveling log at locations angularly spaced between said dogging and holding means, means at said outfeed end for releasing the worked-upon log from said dogging and holding means, and means for driving said carriage means axially from said infeed end to said outfeed end and back to said infeed end.

2. The apparatus as in claim 1 including means for sequentially loading a log into said positioning means at said infeed end.

3. The apparatus as in claim 1 including means at said work station for cutting said log into a plurality of individual elongated sector-shaped pieces.

4. The apparatus as in claim 3 including means at said outfeed end for collecting said sector-shaped pieces after said pieces are released from said dogging and holding means.

5. The apparatus as in claim 1 including means associated with said carriage means for causing said coaxial locations on the ends of said log to move divergently with respect to an axial center line through said work station.

* * * * *